US006558253B1

(12) United States Patent
DeSimone et al.

(10) Patent No.: US 6,558,253 B1
(45) Date of Patent: May 6, 2003

(54) SLOT MACHINE WITH AWARD MULTIPLIER DISPLAY

(75) Inventors: Frank C. DeSimone, Henderson, NV (US); Robert J. Piechowiak, Las Vegas, NV (US); Charles R. Miller, Sr., Henderson, NV (US); Henry C. Nicholson, Henderson, NV (US)

(73) Assignee: Sigma Game, Inc., Las Vegas, NV (US)

( * ) Notice: Subject to any disclaimer, the term of this patent is extended or adjusted under 35 U.S.C. 154(b) by 546 days.

(21) Appl. No.: 09/040,478

(22) Filed: Mar. 17, 1998

Related U.S. Application Data

(63) Continuation-in-part of application No. 29/085,293, filed on May 30, 1997, now Pat. No. Des. 412,347, and a continuation-in-part of application No. 29/070,020, filed on Apr. 18, 1997, now Pat. No. Des. 392,340.

(51) Int. Cl.[7] ..... A63F 9/24
(52) U.S. Cl. ..... 463/20; 463/16; 273/143 R
(58) Field of Search ..... 463/16, 20, 26, 463/27, 28; 273/143 R

(56) References Cited

U.S. PATENT DOCUMENTS

| | | | | |
|---|---|---|---|---|
| 3,281,149 A | | 10/1966 | Miller | 273/143 |
| 4,805,907 A | | 2/1989 | Hagiwara | 273/138 A |
| 4,871,171 A | | 10/1989 | Rivero | 273/138 A |
| 5,205,555 A | | 4/1993 | Hamano | 273/143 R |
| 5,259,616 A | | 11/1993 | Bergmann | 273/138 A |
| 5,342,049 A | | 8/1994 | Wichinsky et al. | 273/119 R |
| 5,344,145 A | | 9/1994 | Chadwick et al. | 273/138 A |
| 5,531,441 A | | 7/1996 | Dabrowski et al. | 463/12 |
| 5,823,874 A | * | 10/1998 | Adams | 463/17 |
| 5,839,955 A | * | 11/1998 | Managano et al. | 463/16 |
| 5,848,932 A | | 12/1998 | Adams | 463/20 |
| 5,851,148 A | * | 12/1998 | Brune et al. | 463/25 |

FOREIGN PATENT DOCUMENTS

| | | | |
|---|---|---|---|
| DE | 37 00 861 | 7/1988 | G07F/17/34 |
| DE | 40 14 477 | 7/1991 | G07C/15/00 |
| EP | 0 333 338 | 9/1989 | G07F/17/32 |
| FR | 1 474 617 | 3/1967 | |
| GB | 1 242 298 | 8/1971 | G07F/17/34 |
| GB | 2 066 991 | 7/1981 | G07F/17/34 |
| GB | 2 072 395 | 9/1981 | G07F/17/34 |
| GB | 2 084 371 | 4/1982 | G07F/17/34 |
| GB | 2 096 376 | 10/1982 | G07F/17/34 |
| GB | 2 201 821 | 9/1988 | G07F/17/34 |
| GB | 2 202 984 | 10/1988 | G07F/17/34 |
| JP | 58-128413 | 8/1983 | A63F/5/04 |
| JP | 61-97650 | 4/1986 | A63F/5/04 |

OTHER PUBLICATIONS

"The Joker's Wild." Jack Barry Productions. Sep. 4, 1972. [online] Retrieved from the Internet [Mar. 8, 2000]. URL <wysiwyg://45/http://www.geocities.com/Hollywood/Hills/5134/joker72.html>.*

Photocopy of Greatest Bally Club Style Console Windsor Castle (1 p.).

Photocopy of Bally Circus (1 p.).

Photocopy of Bally Monte Carlo De Luxe (1 p.).

Photocopy of Bally Double or Nothing (1 p.).

Photocopy of Bally Circus Continental, 3–Dimensional Tunnel Target (1 p.).

Photocopy of Bally Texas Twin (1 p.).

Photocopy of Sigma TV–Poker With Double Game (1 p.).

Photocopy of Sigma TV–Poker (1 p.).

Photocopy of Circa 1970, Bally Circus (1 p.).

* cited by examiner

*Primary Examiner*—Michael O'Neill
*Assistant Examiner*—Julie Brocketti
(74) *Attorney, Agent, or Firm*—Skjerven Morrill LLP

(57) ABSTRACT

A slot machine is described which allows a player to participate in an additional game of chance whenever a winning combination of symbols includes a special bonus multiplier symbol. In such instances, the award for the winning combination is multiplied by a randomly determined value, thereby increasing the attractiveness of the game. In the preferred embodiment, the bonus multiplier is selected using a weighted random number generator.

27 Claims, 6 Drawing Sheets

SLOT MACHINE WITH AWARD MULTIPLIER DISPLAY

CROSS REFERENCE TO RELATED APPLICATIONS

This application is a continuation-in-part of U.S. application Ser. No. 29/070,020, filed Apr. 18, 1997, now U.S. Design Pat. No. Des. 392,340, entitled Display Glass for Slot Machine Showing Award Multiplication Values, by Frank DeSimone, and U.S. application Ser. No. 29/085,293, filed May 30, 1997, now U.S. Design Pat. No. Des. 412,347, entitled Slot Machine Having Award Multiplier Display, by Frank DeSimone, both documents being incorporated herein by reference.

FIELD OF THE INVENTION

This invention relates to slot machines and, in particular, to a variable award multiplier feature for a slot machine.

BACKGROUND OF THE INVENTION

Slot machines employing mechanical reels or video reels are the most popular gaming machines in a casino. Details of such conventional slot machines are found in U.S. Pat. No. 4,095,795 to Saxton et al.; U.S. Pat. No. 4,448,419 to Telnaes; and U.S. Pat. No. 4,573,681 to Okada, all incorporated herein by reference.

Although prior art slot machines are attractive, there is a constant need to increase revenue generated by the machines. Such an increase is typically met by enhancing the machines' appeal to the players. Accordingly, what is needed is a slot machine with more player appeal.

SUMMARY

An improvement on a slot machine is described herein which allows a player to participate in an additional game of chance, namely a variable bonus multiplier (VBM) determination, to obtain an award multiplication factor that multiplies the award for a previous play. The invention may be implemented by relatively minor changes in a prior art slot machine's firmware/software program and pay-table ROM and the addition of a multiplier display.

In the preferred embodiment, the multiplier feature is initiated by the display of a special symbol in a winning combination of symbols. The multiplier factor is generated using a weighted probability routine that assigns unequal probabilities to the possible multiplication factors. Thus, the lower multiplication factors will have a higher probability of being selected than the higher multiplication factors. This results in greater player appeal without incurring a significantly increased payout/pay-in ratio.

DETAILED DESCRIPTION OF THE EMBODIMENTS

Figure 1:
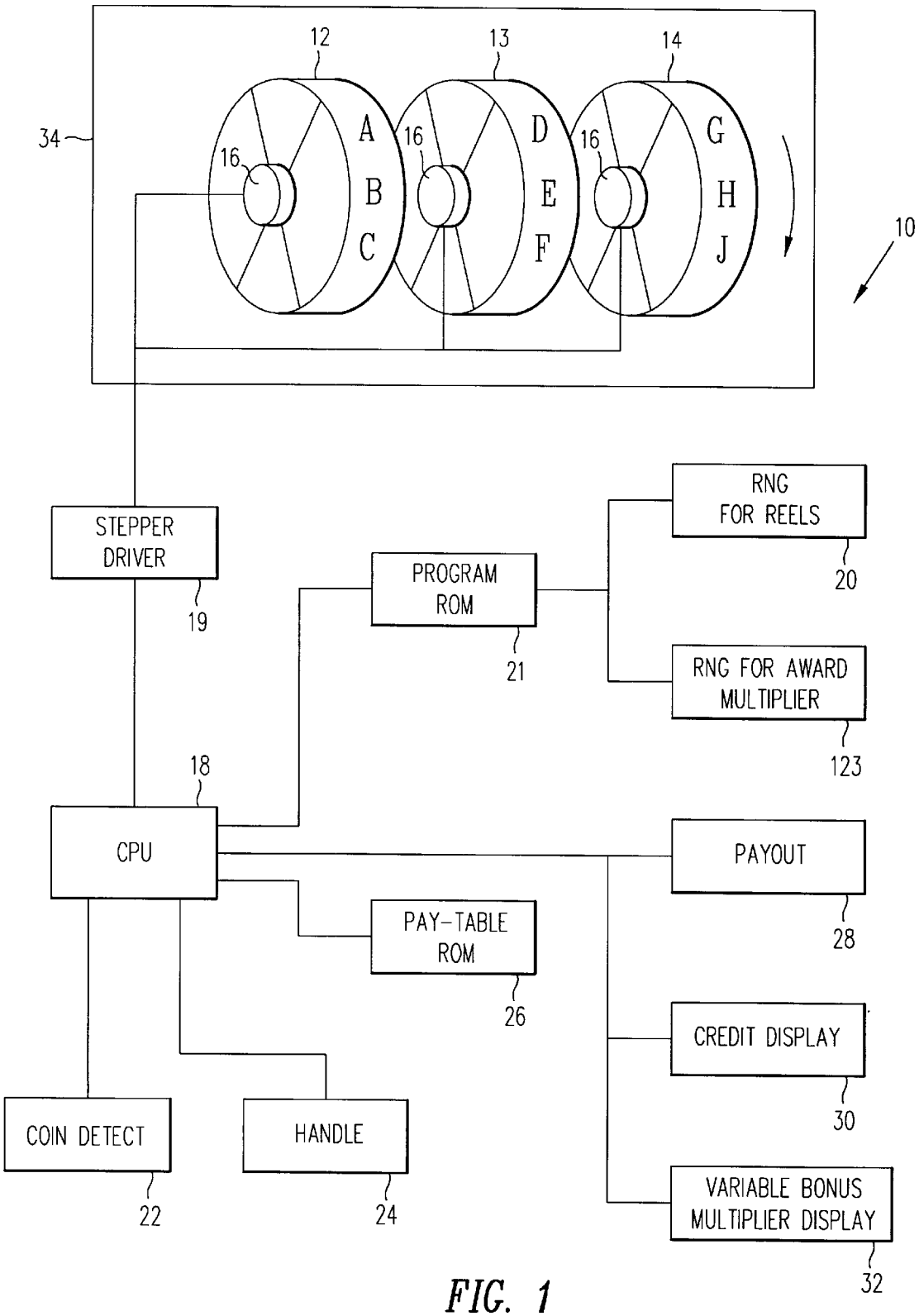
FIG. 1 illustrates the functional units for a slot machine in accordance with one embodiment of the present invention.

FIG. 1 illustrates well known functional units in a modern slot machine 10 as well as the variable bonus multiplier (VBM) feature of the present invention. In slot machine 10, each of the reels 12, 13, and 14 has a variety of symbols printed on its periphery. Each of the reels 12–14 is driven by a separate stepper motor 16 which rotates in response to signals from a CPU 18. A driver 19 issues pulses to motors 16 to rotate as commanded by CPU 18.

The number of pulses delivered to each stepper motor 16 determines the stopping positions of the reels 12–14 and thus determines the award to be paid out to the player. In many modern slot machines, the stopping positions of the reels 12–14 are predetermined using a random number generator (RNG) 20 consisting of a random number generator program in the program ROM 21 carried out by the CPU 18. The RNG 20 is shown separately in FIG. 1 for clarity. ROM 21 (or other memory device) also contains the instructions for carrying out the game. The required number of pulses to the three stepper motors 16 are then generated to display the symbol combination at the predetermined reel positions.

In one known technique, the number of pulses are counted to determine the final position of the reels. In another technique, each of the reels has tabs or other light shielding portions that are sensed by a photodetector to determine the angular displacement of the reel and thus the final displayed symbol. Other means for detecting the positions of the reels exist and are well known.

A money detector 22, which may detect coins or other currency, issues a command to the CPU 18 that the slot machine 10 is ready to be played. The player may then pull a handle 24 or press a button to initiate play.

After the CPU 18 determines the final stop positions and the reels have stopped, the stop positions are then applied to a pay-table ROM 26, which cross-references the final displayed symbols (or reel stop positions) with a monetary payout to the player. This payout is then conveyed to a payout mechanism 28 which issues coins or credits to the player. If credits are issued, a credit display 30 is incremented.

The above general description of a modern slot machine is well known in the art, and such a programmable machine offers significant advantages. The operation of a slot machine is varied by simply changing the operating program in the program ROM 21 and the award program in the pay-table ROM 26. The front glass of the slot machine is also changeable to convey particular features of the machine.

FIG. 1 also illustrates an additional feature of a slot machine in accordance with the present invention. This feature will be referred to as a variable bonus multiplier (VBM), which randomly multiplies an award when certain conditions are met. The multiplier is displayed by a VBM display 32. An example of such an award multiplier condition is a winning combination of symbols that includes a special bonus symbol. The VBM feature may be initiated by pressing a button, or, alternatively, the machine may automatically initiate the VBM feature to randomly select an award multiplier.

Figure 2:
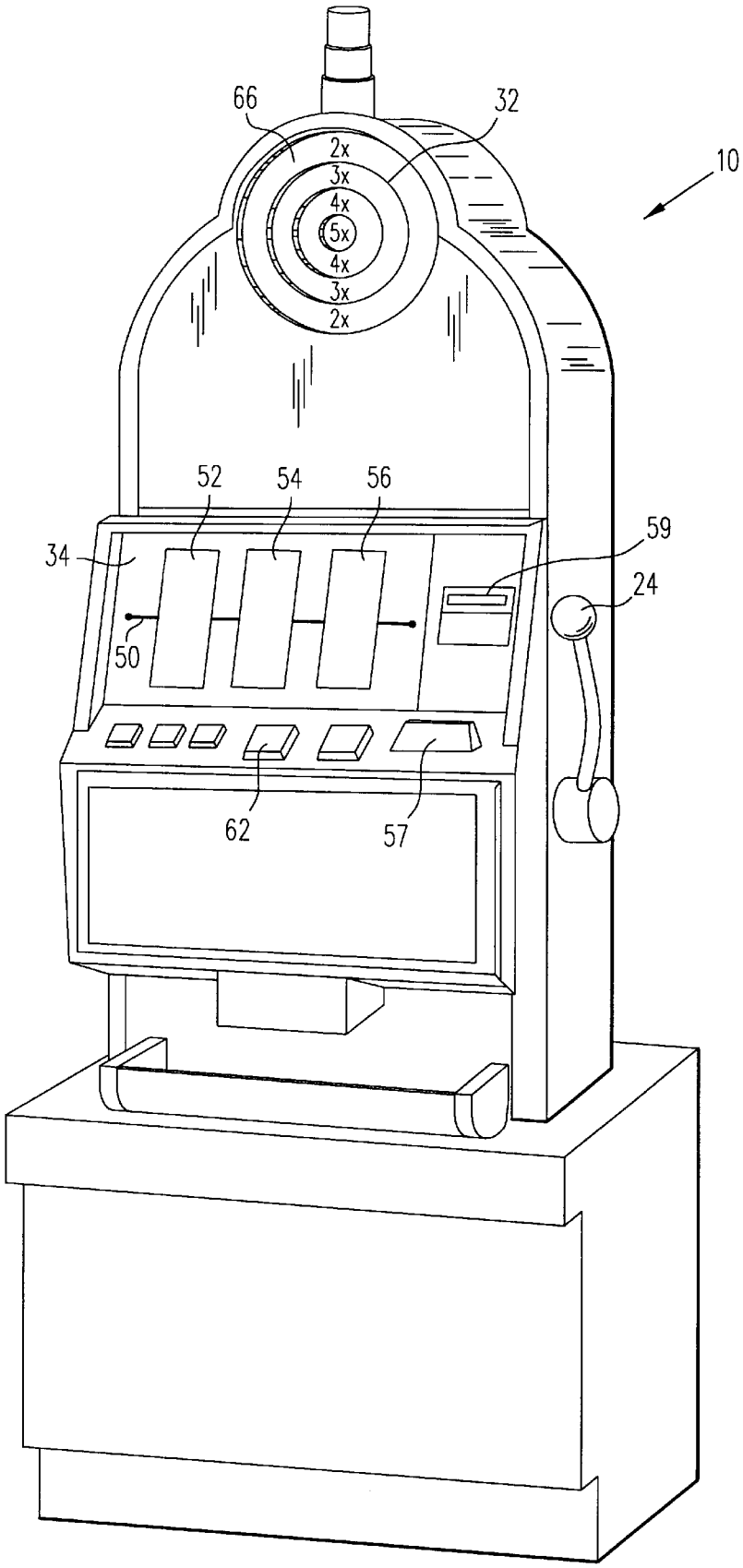
FIG. 2 is a perspective view of a slot machine incorporating one embodiment of the present invention.
Figure 3:
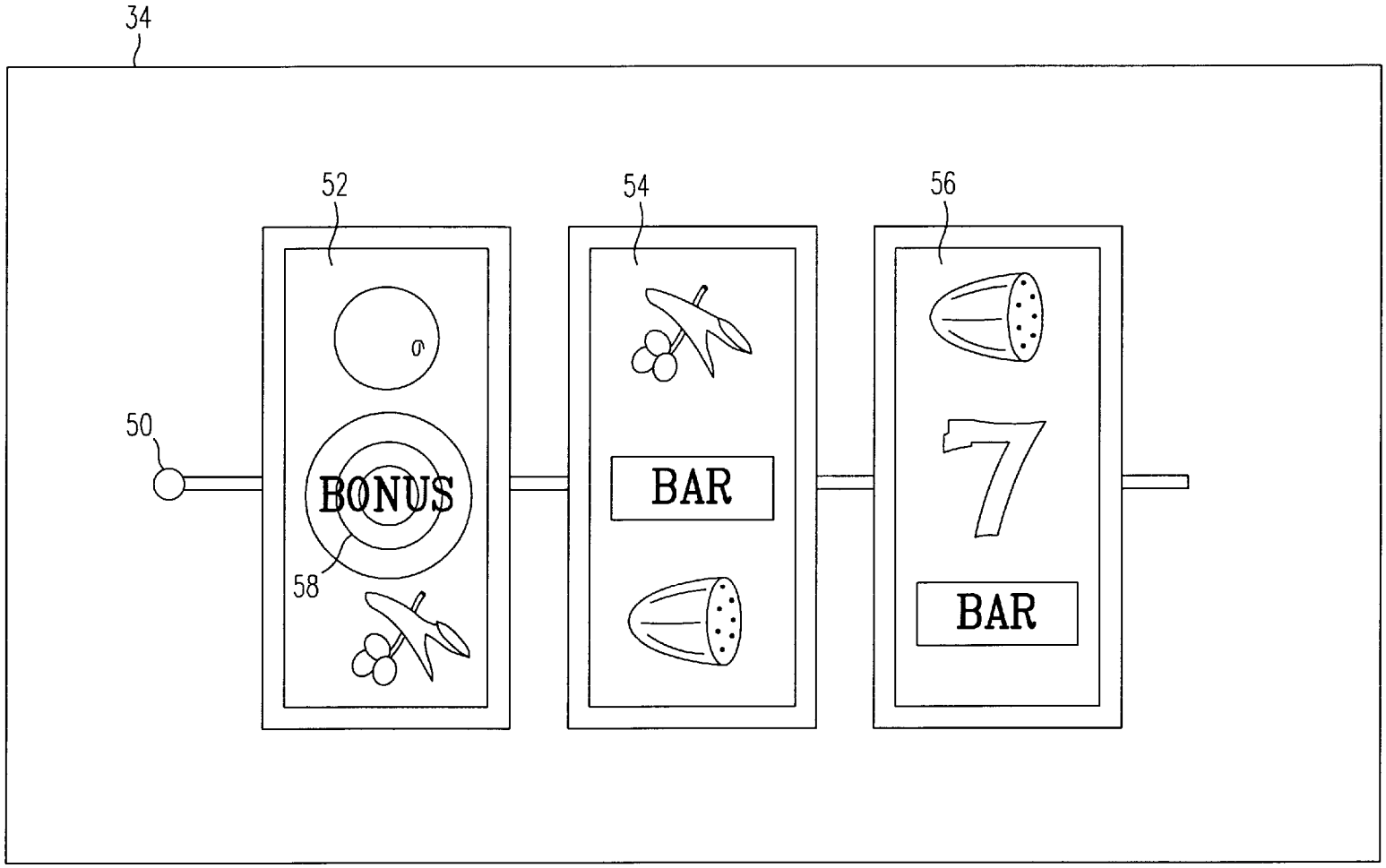
FIG. 3 is a detailed view of display area 34 in FIG. 2.
Figure 4:
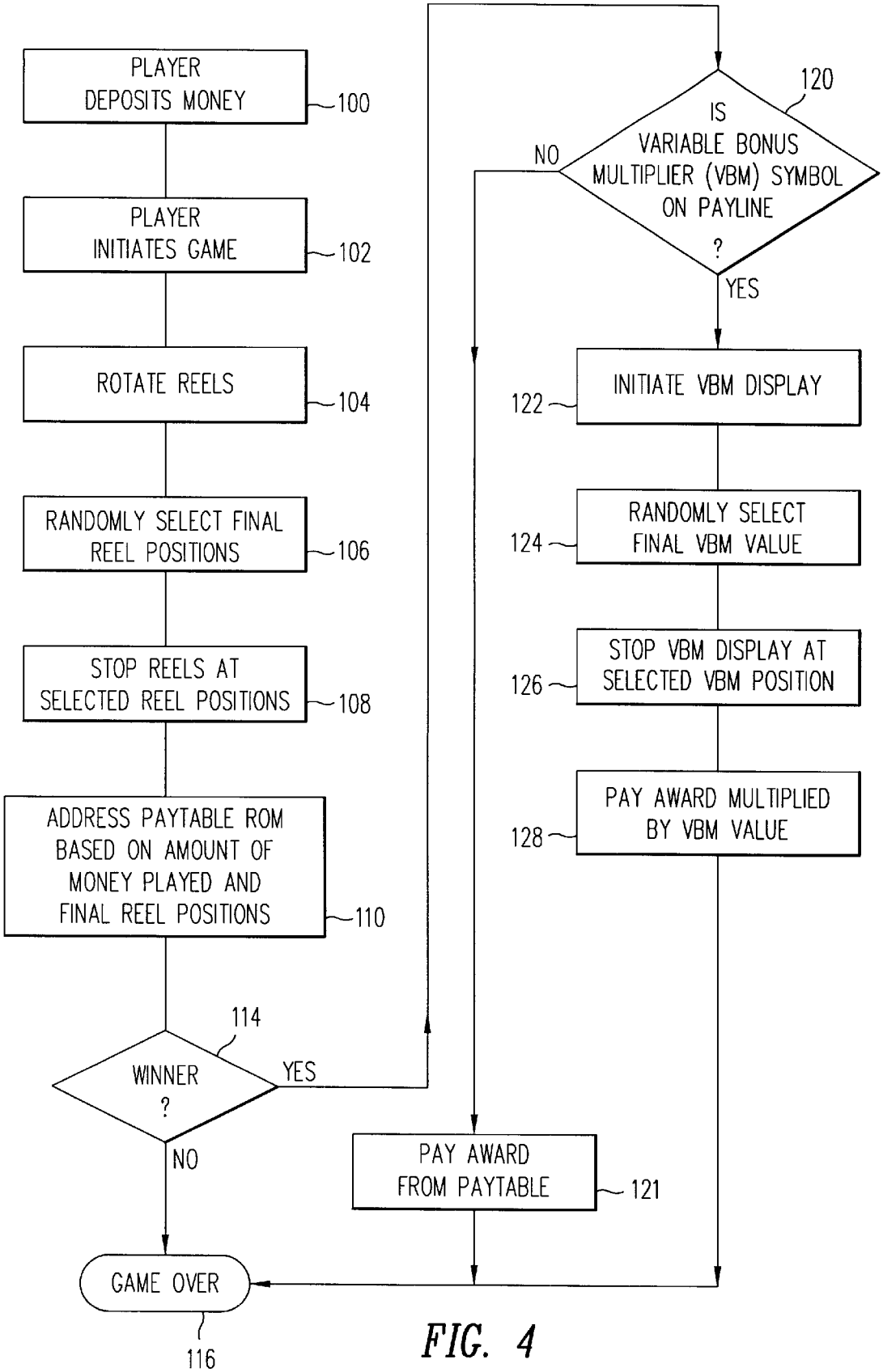
FIG. 4 is a flow diagram illustrating the basic steps carried out by a slot machine in accordance with one embodiment of the present invention.

A description of one embodiment of the invention will be presented with reference to FIG. 1, the slot machine of FIG. 2, the display area enlargement of FIG. 3, and the flow chart of the slot machine operation in FIG. 4. Elements identified with the same numerals in the various figures may be identical and will not be redundantly described.

In step 100 in FIG. 4, a coin is deposited through slot 57 (FIG. 2) and is detected by the coin detector 22. A paper currency slot and reader 59 may also be incorporated in the slot machine of FIG. 2. The detection of the coin and the pulling of handle 24, or the pressing of button 62 by the player, initiates a next game, as indicated in step 102 of FIG. 4.

The CPU 18 (FIG. 1), under control of the program ROM 21, rotates the reels 12–14 by causing pulses to be issued to the stepper motors 16, as indicated by step 104 in FIG. 4. In step 106, a random number generator 20 selects the final reel positions for reels 12–14. CPU 18 issues the required number of pulses to stepper motors 16 in order to cause the reels 12–14 to stop at their predetermined stop positions. The positions of the reels 12–14 may be determined by various techniques, as previously described. In step 108, the reels are stopped at their selected positions.

The reels are displayed through display windows 52, 54, and 56 in FIG. 2. A slot machine incorporating this invention may include more than three reels. In the particular embodiment shown in FIG. 2, three consecutive symbols on each of reels 12–14 are displayed through the display windows 52, 54, and 56 of display area 34. A symbol may be any image and may even be a blank.

A payline 50 is printed on the display glass of the slot machine. A slot machine may have more than one payline printed on the display glass to identify the paylines that are applicable for a particular play. In such an embodiment, the deposit of one coin will activate payline 50, and additional coins will activate the additional paylines. A winning combination of symbols appearing across any activated payline will result in a win for that player.

The operation of the disclosed slot machine, thus far, has been that of a conventional slot machine.

Once the reels are stopped at their selected positions, CPU 18 addresses pay-table ROM 26, based on the number of coins played and the final reel positions, to determine if the selected combination of symbols is a winning combination, as shown in step 114. If the selected combination of symbols is not a winning combination, the game ends, as shown in step 116.

However, in one embodiment of the present invention, if the combination is a winner, the program contained in program ROM 21 also controls the machine to determine if one or more variable bonus multiplier (VBM) symbols 58 (FIG. 3) are included in the winning combination, as shown in step 120. If a VBM symbol is not included, the program instructs CPU 18 to pay the winnings based on the number of coins played and the winning combination of symbols as specified in pay-table ROM 26, as shown in step 121, and activates payout mechanism 28 to pay the player. Alternatively, credit display 30 may be incremented by the appropriate number of credits. The game then ends.

If the VBM symbol 58 is present, the program initiates cycling of the VBM display 32 (FIGS. 1 and 2), as shown in step 122, by, for example, illuminating the VBM display 32. Alternatively, a display element (e.g., a flashing display on the display glass) may instruct the player to initiate the VBM display cycling by pulling handle 24 or depressing a button.

In one embodiment, when the VBM feature is initiated, the bonus multiplier value is selected using a weighted random number generator (RNG) 123 (FIG. 1) consisting of an RNG program in the program ROM 21 carried out by the CPU 18, as shown in step 124. This weighted RNG 123 is shown as a separate function in FIG. 1 for clarity. This function may be carried out by the same or a different method than that used to select the reel stopping positions. Using a weighted RNG program, the probability of each possible outcome is not equal. Hence, the probability of the VBM doubling the award can be set to be higher than that of the VBM generating a greater multiplier. One method for implementing such a weighted RNG is to assign numbers to each possible multiplier value, where more numbers are assigned to the lower multiplier values. A random number generator will then have a higher likelihood of selecting a number assigned to a lower value multiplier than selecting a number assigned to a high value multiplier.

The selection of a VBM value in step 124 may occur before the VBM display is cycled, anytime during the cycling, or anytime during a game.

In step 126, CPU 18 then stops the cycling of the VBM display 32 at the predetermined bonus multiplier value. The award payout is determined by CPU 18, in conjunction with the pay-table ROM 26, based on the number of coins played, the award for the winning combination of symbols, and the bonus multiplier value. The payout mechanism 28 or the credit display 30 is then activated to pay the player, as shown in step 128.

If more than one VBM symbol 58 is shown on the payline 50, the award is multiplied by the bonus multiplier value times the number of VBM symbols obtained. In another embodiment, the award is multiplied by a separately generated bonus multiplier value for each VBM symbol obtained. The game then ends in step 116.

In another embodiment, no special symbol 58 is needed to initiate the VBM feature. The RNG for the VBM feature may also be any conventional pseudo-random number generator and need not be a weighted RNG.

In the preferred embodiment the physical VBM display 32 is 3-dimensional and consists of a series of concentric rings 66 (FIG. 2) arranged with the smallest diameter ring at the greatest depth. When the VBM display 32 is activated, the rings light cyclically in sequence from the largest diameter to the smallest. Alternatively, sequential or non-sequential illumination schemes are also possible. For example, the rings may be illuminated in a random fashion. The illumination sequence is designed so that there is anticipation and excitement in waiting for it to stop.

Each ring 66 represents a single bonus multiplier value, e.g., 1×, 2×, 3×, 4×, or 5×. More or fewer rings and/or multiplier values are also included within the scope of the present invention.

The rings may also be in a single flat plane.

The present invention adds an additional level of chance and excitement in a way calculated to increase machine revenue yet will not significantly increase the average pay out/in ratio due to the weighted RNG controlling the VBM display 32.

Figure 5:
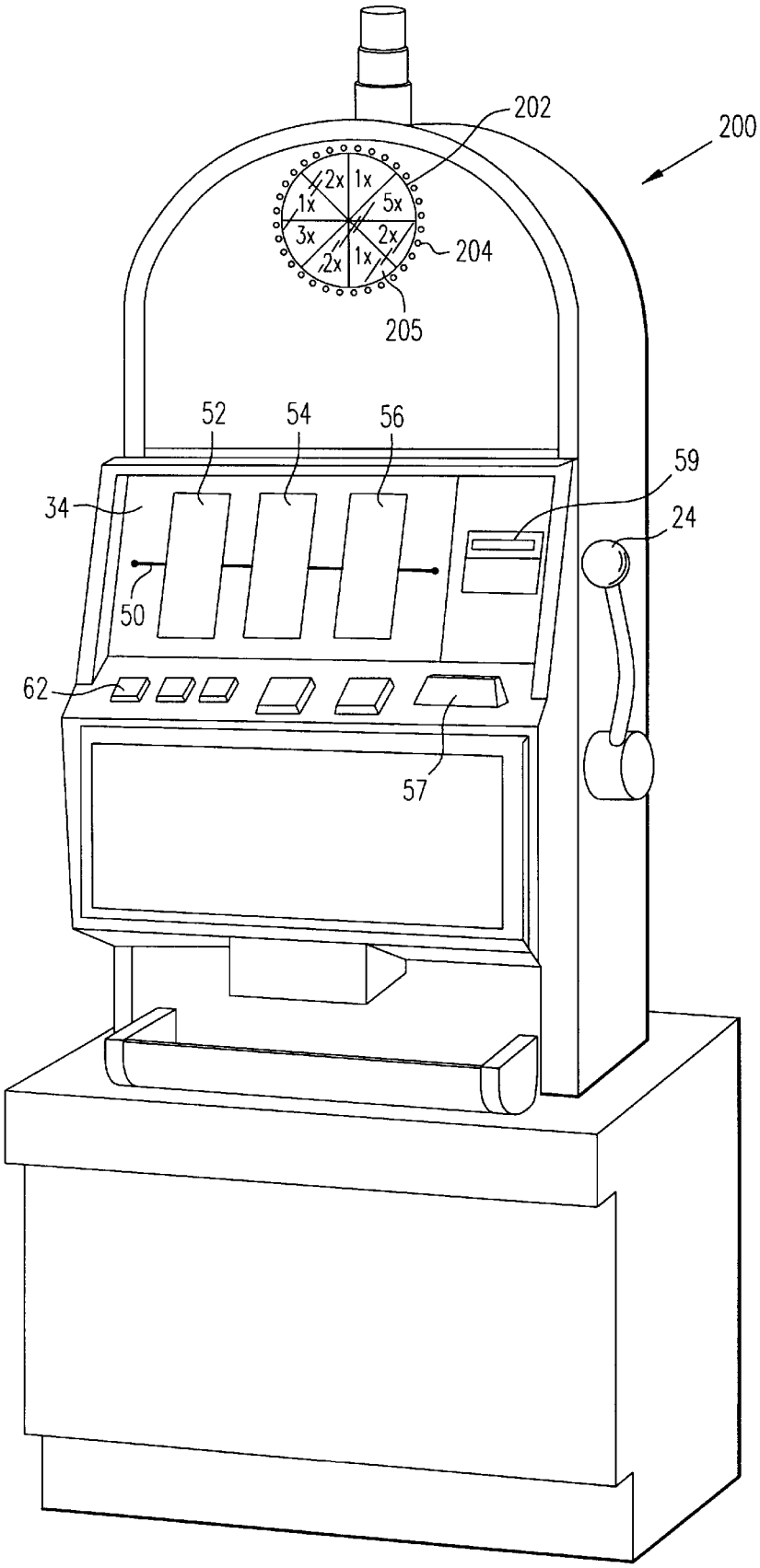
FIG. 5 is a perspective view of a slot machine incorporating an alternate embodiment of the present invention.

FIG. 5 shows an alternate embodiment of a slot machine 200 incorporating a VBM display 202 consisting of a segmented circle with lights 204 around its perimeter. These lights are cyclically illuminated in sequence to give the illusion of a rotating wheel. Alternatively, a group of lights can be illuminated briefly, followed in sequence by the illumination of an adjacent group of lights in either a clockwise or counter-clockwise direction. Other illumination schemes are also envisioned as falling within the scope of this invention. For example all segments 205 or lights 204 may be illuminated jointly or in a random fashion. Each segment 205 (corresponding to the rings 66 in FIG. 5) represents a bonus multiplier value.

In both embodiments of VBM displays, the last illuminated bonus multiplier value is determined in step 124 of FIG. 4. Any number of concentric rings 66 or segments 205 may be employed. The weighted RNG for determining a bonus multiplier value can be used to achieve any desired average multiplier value regardless of the number of positions in the physical VBM display.

The present invention can also be used in slot machines which have multiple paylines or which use a CRT or other flat screen display as display area 34 (FIG. 3) to represent the rotation of reels rather than provide actual mechanical reels.

Figure 6:
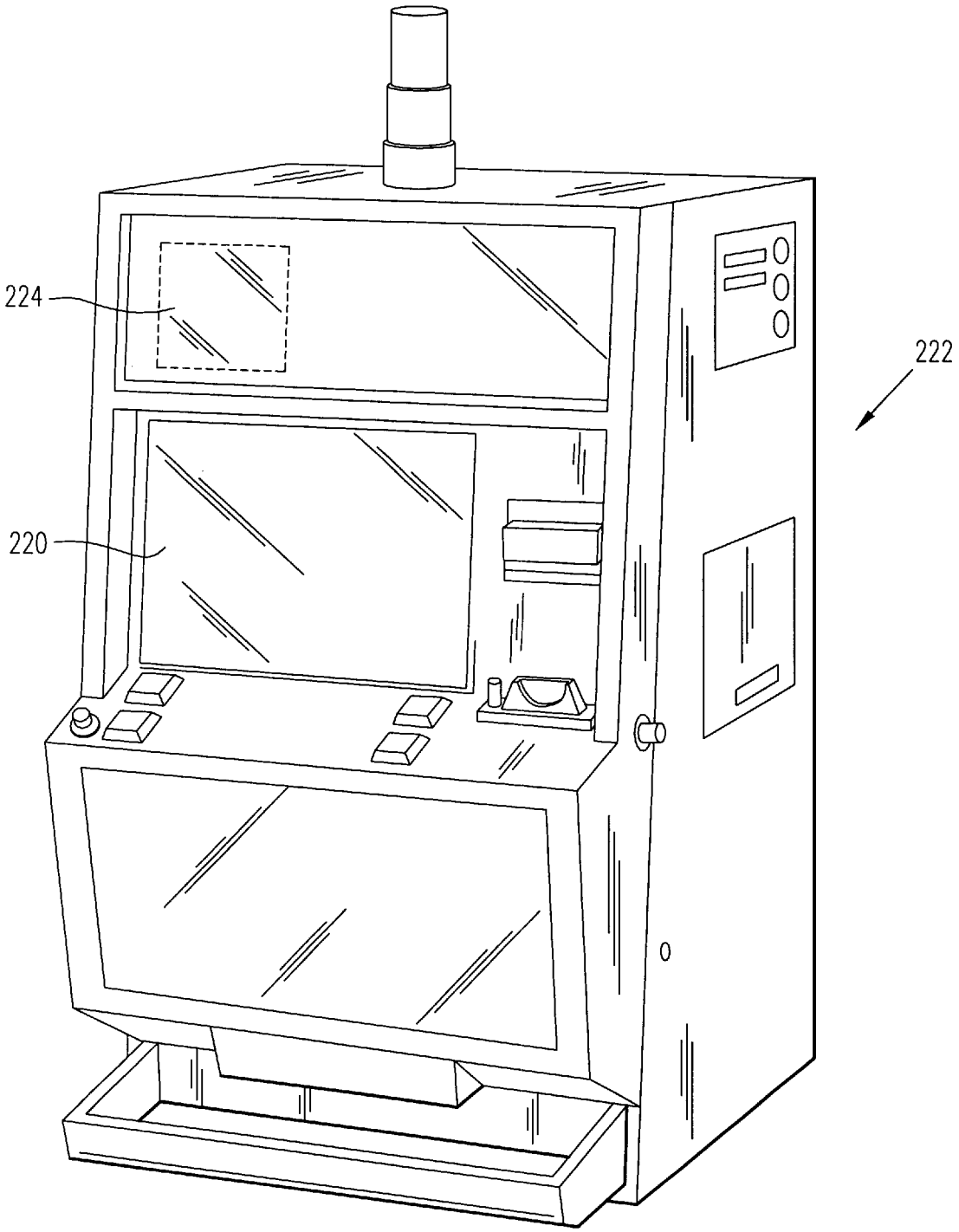
FIG. 6 is a video slot machine incorporating one embodiment of the present invention.

FIG. 6 illustrates a video version of the slot machine of FIGS. 1 and 2. Instead of mechanical reels, simulated reels or other games are shown on a CRT or other display screen 220 by machine 222. The VBM display may also be displayed on screen 220 or on a separate screen 224. Alternatively, the screen 220 and another form of VBM display, such as displays 32 or 202, may be employed in the machine. The operation of machine 222 may be identical to that described with respect to the machine of FIGS. 1 and 2 except for CPU 18 controlling a video display rather than mechanical reels.

Games displayed on screen 220 for which the VBM applies may include poker or any other game. Video poker slot machines are well known and need not be further described herein. An example of a video poker slot machine is described in U.S. Pat. No. 5,531,441, incorporated herein by reference.

The VBM display screen, whether screen 220 or 224, may additionally display other information, as appropriate, including instructions to the player or attention-getting graphics.

The VBM display may be any type of display in addition to those described herein, such as a spinning wheel (either mechanical or electrical).

The activation of the VBM and VBM display in any of the embodiments described herein may be initiated upon any event. Examples include activation of the VBM based upon the number of games played reaching a predetermined number, based upon a random time or randomly selected number of games, based upon a certain poker hand(s) being obtained, based upon a special symbol being displayed, or based upon any other event.

One skilled in the art could easily modify conventional slot machine programs stored in a program memory to incorporate the VBM feature of this invention. One skilled in the art could also easily modify a conventional pay-table ROM to take into account the VBM value when determining a payout. Accordingly, one skilled in the art may implement numerous embodiments of this invention without further technical description.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A slot machine comprising:

a display portion displaying a game having a variety of possible outcomes, said outcomes represented by a plurality of symbols displayed in said display portion, at least one of said outcomes representing a first award amount to a player;

a variable award multiplier for selecting an award multiplier value, wherein said variable award multiplier comprises a random number generator; and a payout device that awards said player said first award amount multiplied by a factor based on said multiplier value when at least one of said plurality of symbols is a bonus symbol.

2. The slot machine of claim 1 wherein said display portion comprises rotatable reels rotated by at least one motor.

3. The slot machine of claim 1 wherein said display portion comprises an electronic display device having a display screen for displaying said game.

4. The slot machine of claim 3 wherein said award multiplier value is also displayed on said display screen.

5. The slot machine of claim 3 wherein said award multiplier value is displayed on a different display screen.

6. The slot machine of claim 1 wherein said award multiplier value is displayed on a display screen.

7. The slot machine of claim 1 wherein said variable award multiplier comprises:

an award multiplier display that dynamically displays a plurality of award multiplier values and stops on a multiplier value selected by said random number generator.

8. The slot machine of claim 7 wherein said award multiplier display comprises a plurality of individually illuminable concentric rings.

9. The slot machine of claim 8 wherein each of said rings is in a different plane, each of said rings denoting one of said plurality of award multiplier values.

10. The slot machine of claim 8 wherein said rings are displayed on a display screen.

11. The slot machine of claim 7 wherein said award multiplier display comprises a radially segmented disk.

12. The slot machine of claim 11 wherein each said segment is individually illuminable and denotes one of said plurality of award multiplier values.

13. The slot machine of claim 11 wherein said segmented disk has a plurality of light sources arranged around a perimeter of said disk.

14. The slot machine of claim 13 wherein said plurality of light sources are individually controllable to light in sequence.

15. The slot machine of claim 13 wherein said plurality of light sources are individually controllable to light in a random fashion.

16. The slot machine of claim 1 wherein:

said display portion displays a plurality of rotatable reels, each reel having a plurality of symbols on its periphery including at least one bonus symbol on each reel; wherein said variable award multiplier selects a multiplier value when said at least one bonus symbol is displayed and a winning combination of symbols is displayed, said winning combination of symbols representing said first award to be paid to a player; and wherein said payout device awards said player said first award multiplied by a factor based on said multiplier value.

17. The slot machine of claim 16 wherein said first award is multiplied by said multiplier value times a number of bonus symbols displayed.

18. The slot machine of claim 16 wherein multiplier value is generated for each bonus symbol displayed, and said first award is multiplied by each said value generated.

19. The slot machine of claim 1 wherein said game is poker.

20. The slot machine of claim 1 wherein said game displays rotating reels with symbols thereon.

21. The slot machine of claim 1 wherein said variable award multiplier is initiated for multiplying said first award when a special symbol is displayed in said game.

22. The slot machine of claim 1 wherein said variable award multiplier is initiated for multiplying said first award when a certain number of games have been played.

23. A method for operating a slot machine comprising:

playing a game to generate one of a plurality of game results, said game results represented by a plurality of symbols, at least one of said game results representing a first award amount to a player;

determining an award multiplier value by operating a random number generator to select said award multiplier value; and determining an award payment to a player, said award payment being said first award multiplied by said award multiplier value when at least one of said plurality of symbols is a bonus symbol.

24. The method of claim 23 wherein said step of determining an award multiplier value further comprises:

dynamically displaying a plurality of award multiplier values;

stopping said dynamically displaying to display a particular award multiplier value.

25. The method of claim 24 wherein said dynamically displaying comprises sequentially illuminating light elements in a display device, said illuminating denoting award multiplier values associated with said light elements.

26. The method of claim 23 wherein said step of playing a game comprises:

displaying a plurality of rotating reels in said slot machine, each of said reels having a plurality of symbols around its periphery including at least one bonus symbol on each reel;

stopping said reels to display a particular winning symbol combination;

determining an award multiplier value when at least one said bonus symbol is displayed as part of said symbol combination; and determining an award payment to a player for said winning symbol combination incorporating said bonus symbol, said award payment being an award for said winning symbol combination multiplied by said award multiplier value.

27. The method of claim 23 wherein said game is poker.

* * * * *